US006632060B1

(12) United States Patent
Gilmore et al.

(10) Patent No.: US 6,632,060 B1
(45) Date of Patent: Oct. 14, 2003

(54) PRE-REGISTRATION SYSTEM FOR BOARD PLACEMENT

(75) Inventors: Scott Gilmore, Elgin, IL (US); Jason Ernst, Elgin, IL (US)

(73) Assignee: Smart Motion Robotics, Inc., Gilberts, IL (US)

( * ) Notice: Subject to any disclaimer, the term of this patent is extended or adjusted under 35 U.S.C. 154(b) by 0 days.

(21) Appl. No.: 09/805,787

(22) Filed: Mar. 13, 2001

(51) Int. Cl.[7] ..... B42B 13/00
(52) U.S. Cl. ..... 412/9; 412/3; 412/17
(58) Field of Search ..... 412/9, 5, 11, 1, 412/14, 3, 17, 25

(56) References Cited

U.S. PATENT DOCUMENTS

| | | | | |
|---|---|---|---|---|
| 3,522,129 A | * | 7/1970 | Crathern, III | |
| 3,708,813 A | * | 1/1973 | Carter et al. | 412/21 |
| 4,129,914 A | * | 12/1978 | Jahn | 29/281.4 |
| 4,336,094 A | * | 6/1982 | Mills | 156/299 |
| 4,345,960 A | * | 8/1982 | Mims et al. | 156/264 |
| 6,153,047 A | | 11/2000 | Gunasekera et al. | 156/463 |

OTHER PUBLICATIONS

Brochure from Colpitt Systems, Inc., P.O. Box 811, Tannersville, PA 18372.

* cited by examiner

*Primary Examiner*—Monica Carter

(74) *Attorney, Agent, or Firm*—Jenner & Block, LLC

(57) ABSTRACT

The present invention provides an apparatus and method for pre-registering boards for use in, for example, the manufacture of looseleaf binders and packaging products. Boards are dropped onto the base plate by an automatic process. Spine guides enable the spine portion of the boards to be secured for subsequent registering. The movement of the spine guides allows the spine portion of the boards to be placed accurately. The spine guides are attached to a spine guide rack which is located on the underside of the base plate. The spine guide rack operates through the use of pneumatic cylinders and enables the movement of the attached spine guides. The spine guides move along a spine guide trench and secure boards on the base plate. The spine guides are retracted when the boards are initially placed on the base plate and then start moving medially to squeeze the spine portion of the board such that it becomes perpendicular to the x-axis. The spine guides also allow for the requisite spacing in between the spine panel and the front and back board panels. This securing apparatus which includes, among other things, the movable guide bars and spine guides, enables the placement of boards and the subsequent binding process to be within desired tolerances. Once the spine guides have set the spine portion of the boards, movable guide bars begin pushing the front and back panels medially towards the y-axis. The movable guide bars will cease movement when the medial edge of the board panel comes into contact with the lateral edge of the spine guides. At this point, the movable guide bars-fixed perpendicular to the x-axis-will correct the panel positions such that the medial panel edges will achieve substantial perpendicularity with the x-axis.

5 Claims, 5 Drawing Sheets

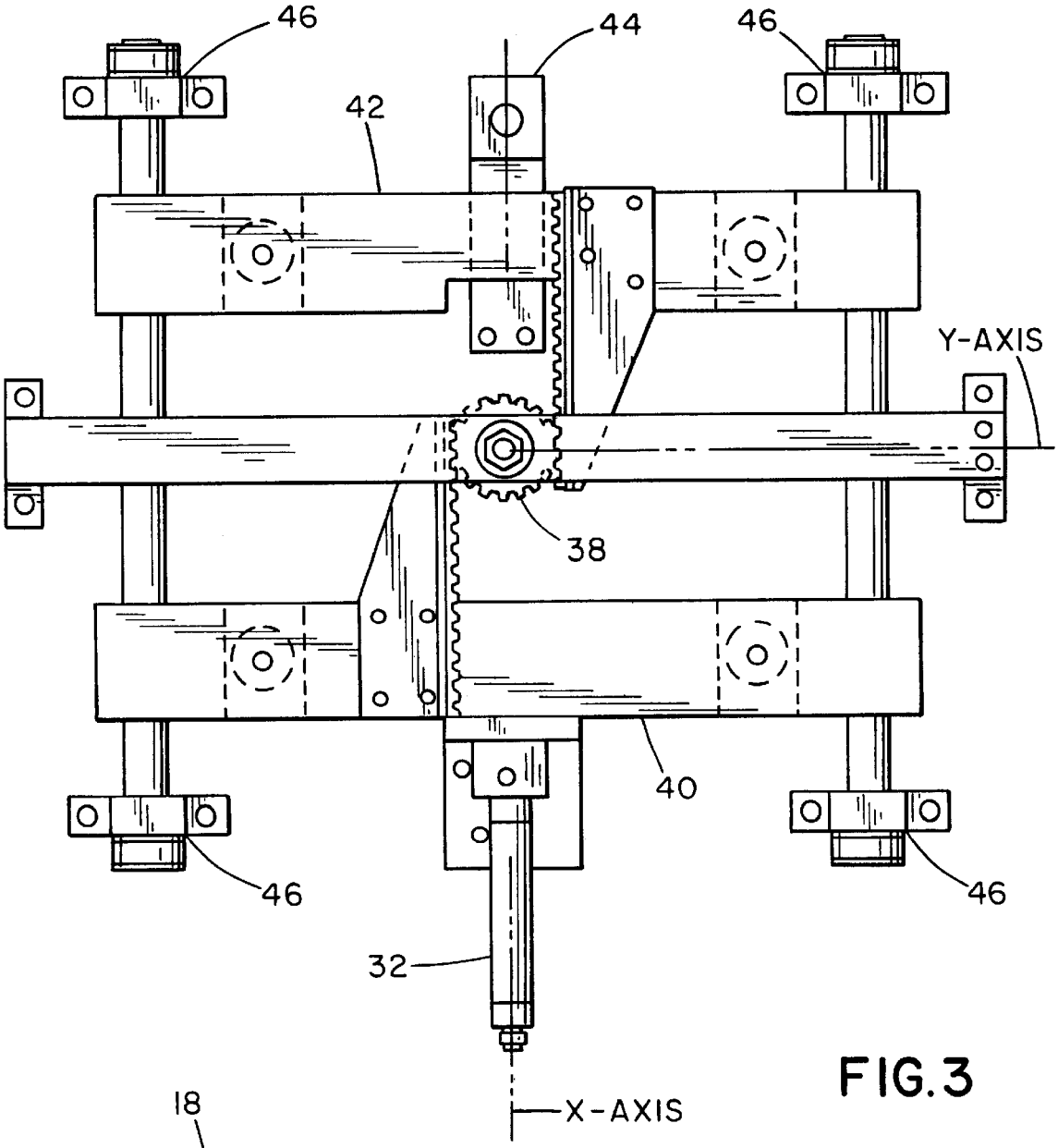
FIG.3
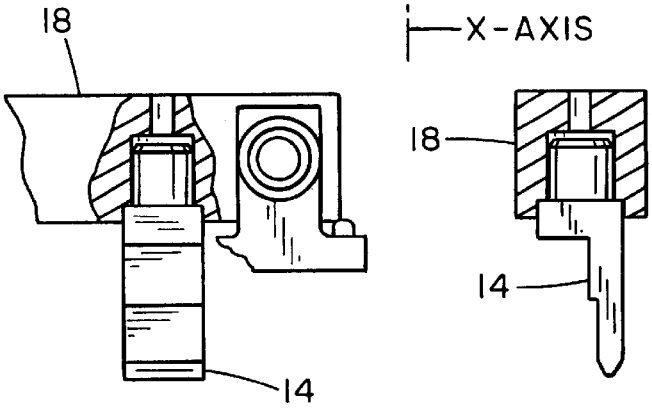

PRE-REGISTRATION SYSTEM FOR BOARD PLACEMENT

FIELD OF THE INVENTION

The present invention relates to an apparatus for pre-registering board placement generally, and more specifically an apparatus for enabling board placement to occur with minimal or no error. The present invention is particularly concerned with the fast, accurate, automated placement of boards for use in the looseleaf binder and packaging industries.

BACKGROUND OF THE INVENTION

The manufacture of looseleaf binders and certain packaging products requires that boards be pre-registered in the manufacturing apparatus prior to being combined with the other elements of the binder or product. Boards are, for example, the panels that comprise a conventional three-ring binder used to hold looseleaf paper. In the process of registering the boards, three panels are used that comprise the binder: the front panel, the back panel, and the spine panel. See, for example, the method for such assembly described in U.S. Pat. No. 5,882,135. The panels are generally made of cardboard and coated with, for example, polyvinylchloride. Because of the precise measurements required of such products, the boards' pre-registration must be within certain tolerances. For products such as looseleaf binders, the boards must be laid within a tolerance of $1/64^{th}$ of an inch and the gap between the various boards of a single product must be as close to perfectly straight as possible.

In the past, boards had to be loaded manually, one at a time, onto a registration apparatus that ultimately produced looseleaf binders and the like. This was a slow, costly, and ineffective process. An improvement to that system came with the automation of board placement. This created a faster, more efficient way to place the boards for binding. However, these systems have a major drawback—they do not produce the accuracy needed for such a precise process. Such boards cause further manufacturing problems and typically require the resulting binders to be discarded. Accordingly, there is a need for an improvement to the looseleaf board placement methods that produces efficient, high quality, pre-registered boards for successful placement.

SUMMARY OF THE INVENTION

The present invention provides an apparatus and method for pre-registering boards for use in, for example, the manufacture of looseleaf binders and packaging products. The apparatus of the present invention accurately pre-registers boards by positioning the boards placed on a base plate and securing them into place.

Initially, the boards are dropped onto the base plate by an automatic process. The present invention includes spine guides which enable the spine portion of the boards to be secured for subsequent registering. The movement of the spine guides allows the spine portion of the boards to be placed accurately. The spine guides are attached to a spine guide rack which is located on the underside of the base plate. The spine guide rack operates through the use of pneumatic cylinders and enables the movement of the attached spine guides. The spine guides move along the spine guide trench and secure boards on the base plate. The spine guides are retracted when the boards are initially placed on the base plate and then start moving medially to squeeze the spine portion of the board such that it becomes perpendicular to the x-axis. The spine guides also allow for the requisite spacing in between the spine panel and the front and back board panels. This securing apparatus which includes, among other things, the movable guide bars and spine guides, enables the placement of boards and the subsequent binding process to be within desired tolerances.

Once the spine guides have set the spine portion of the boards, the movable guide bars will begin pushing the front and back panels medially towards the y-axis. The movable guide bars will cease movement when the medial edge of the board panel comes into contact with the lateral edge of the spine guides. At this point, the movable guide bars-fixed perpendicular to the x-axis-will correct the panel positions such that the medial panel edges will achieve substantial perpendicularity with the x-axis.

Pneumatic cylinders enable the movement of the guide bars and a programmable logic controller controls the movement of the cylinders. Because rectification of the spine portion of the board by the spine guides is not sufficient for ultimate board placement accuracy, the movable guide bars further rectify the front and back board panels. The guide bars cease movement when they encounter a board that is placed onto the base plate. The pneumatic cylinders extend to a certain length and will stop moving when the boards encounter resistance. Once movement has ceased, the movable guide bars will be locked into the setup holes that are part of the base plate. This locking of the guide bars eliminates their tendency to shift and cause errors in the registration of the boards. By ceasing movement upon contact with the placed board, the guide bars secure the board in a position that enables the boards to be lifted from the base plate and subsequently placed on, for example, a revolving turntable for binding.

Additional advantages and features of the present invention will become apparent from the reading of the attached description of the preferred embodiment and the following set of drawings.

BRIEF DESCRIPTION OF THE DRAWINGS

FIG. 3 is a schematic diagram of the underside of the base plate incorporating the spine guide rack;

DETAILED DESCRIPTION OF THE PREFERRED EMBODIMENT

The pre-registration system of the present invention for board placement and other similar operations overcomes the disadvantages of prior systems by enabling users to produce an accurately registered board that is aligned within desired tolerances such that the margin of error is minimal and the percentage of board spoilage due to misalignment is reduced.

Figure 1:
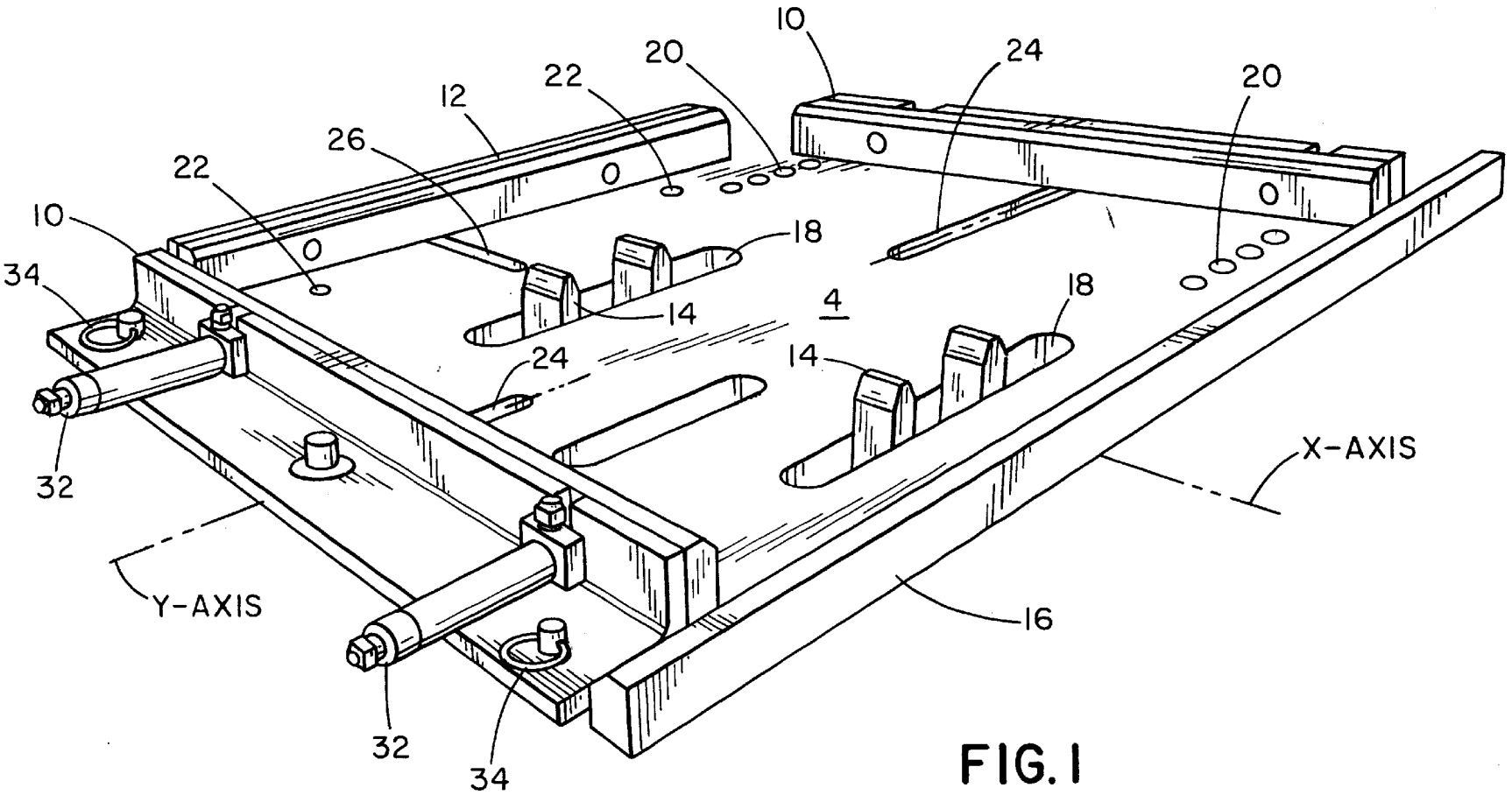
FIG. 1 is a schematic diagram of the pre-registration system incorporating the present invention.

FIG. 1 depicts schematically base plate 4 in accordance with the present invention. Base plate 4 includes at least one x-axis movable guide bar 10, at least one y-axis movable guide bar 12, at least two spine guides 14, a datum bar 16 for calibrating boards placed on base plate 4, at least one spine guide trench 18, x-axis perforations 20, y-axis perforations 22, x-axis trench 24, and y-axis trench 26.

X-axis movable guide bar 10, of which there are preferably two, can move medially and laterally along the x-axis. X-axis movable guide bar 10 begins moving when panels (not shown) are placed on the lateral side of spine guide 14. At this point x-axis movable guide bar 10 begins moving medially toward spine guide 14 along the x-axis. This movement may, be accomplished through the use of pneumatic cylinder 32 controlled via a programmable logic controller (not shown). X-axis movable guide bar 10 will continue moving medially until the panel is in contact with spine guide 14. Because x-axis movable guide bar 10 moves along and is perpendicular to the x-axis, any angular displacement of board panels will be corrected.

Similarly, y-axis movable guide bar 12 can move proximally and distally along the y-axis. Y-axis movable guide bar 12 begins moving proximally when the panels are placed on the lateral side of spine guide 14 and subsequent to the medial motion of x-axis movable guide bar 10. Movement by y-axis movable guide bar 12 may be accomplished through the use of a pneumatic cylinder (not shown in FIG. 1) similar to the cylinder described above and controlled via the programmable logic controller. Y-axis movable guide bar 12 will continue to move proximally until the panels are in contact with datum bar 16. Because y-axis movable guide bar 12 moves along the y-axis and is parallel to the x-axis, any angular displacement of board panels will be corrected.

Similarly, spine guide 14 corrects any angular displacement of the spine panel and enables the spine panel to achieve substantial perpendicularity with respect to the x-axis. Spine guide 14, depicted in FIG. 1, of which there are preferably four, has lateral and medial motion capabilities along the x-axis. Spine guide 14 is controlled by a spine guide rack, as shown in FIG. 3, located on the underside of base plate 4. When base plate 4 is ready to receive board panels, spine guide 14 moves laterally along the x-axis through spine guide trench 18 with spine guide 14 extending out of spine guide trench 18 at a desired height. Preferably, the height of the spine guides 14 extend above the top of the boards. Spine panels are placed on base plate 4 on the medial side of spine guide 14 perpendicular to spine guide trench 18 and parallel with the y-axis. Once spine portion of board panels are placed on base plate 4, spine guide 14 begins moving medially along spine guide trench 18 towards the y-axis. Spine guide 14 will contact the spine panels and cease movement when sufficient resistance greater than pneumatic cylinder 32 force is achieved.

Datum bar 16 allows for calibration of boards placed on base plate 4 after the above process has taken place. Datum bar 16 acts as a reference for the pre-registration system of the present invention and is fixed perpendicular to the x-axis or the y-axis.

X-axis perforations 20 ensure the stability and perpendicularity of x-axis movable guide bar 10 to the x-axis to ensure the correct registration of board panels. X-axis perforations 20 are located in pairs parallel to the x-axis and act as guides for x-axis movable guide bar 10. When x-axis movable guide bar 10 comes in contact with a panel x-axis movable guide bar 10 will cease movement and movable guide bar pins 34 will fall and become "locked" into a pair of x-axis perforations 20 which likewise allow panels to be "locked" into position.

Similarly, y-axis perforations 22 are located in pairs parallel to the y-axis and act as guides for y-axis movable guide bar 12. When y-axis movable guide bar 12 makes contact with the panels the panels are pushed into contact with datum bar 16. Y-axis movable guide bar 12 then will cease movement and movable guide bar pins 34 will fall and become "locked" into a pair of y-axis perforations 22 which likewise allow panels to be "locked" into position. Y-axis perforations 22 ensure the stability and perpendicularity of y-axis movable guide bar 10 along the y-axis to ensure the correct registration of board panels.

To further ensure the stability of the x- and y-axis movable guide bars, base plate 4 includes trenches 24 and 26. X-axis trench 24 lies along the x-axis and acts as a "track" for x-axis movable guide bar 10 to ensure it stays on course when moving medially and laterally. X-axis movable guide bar 10 maintains course within the x-axis trench 24 by being fastened within the trench by a nut or similar locking device. Similarly, y-axis trench 26 lies along the y-axis and acts as a "track" for y-axis movable guide bar 12 to ensure it stays on course when moving proximally and distally.

Figure 2:
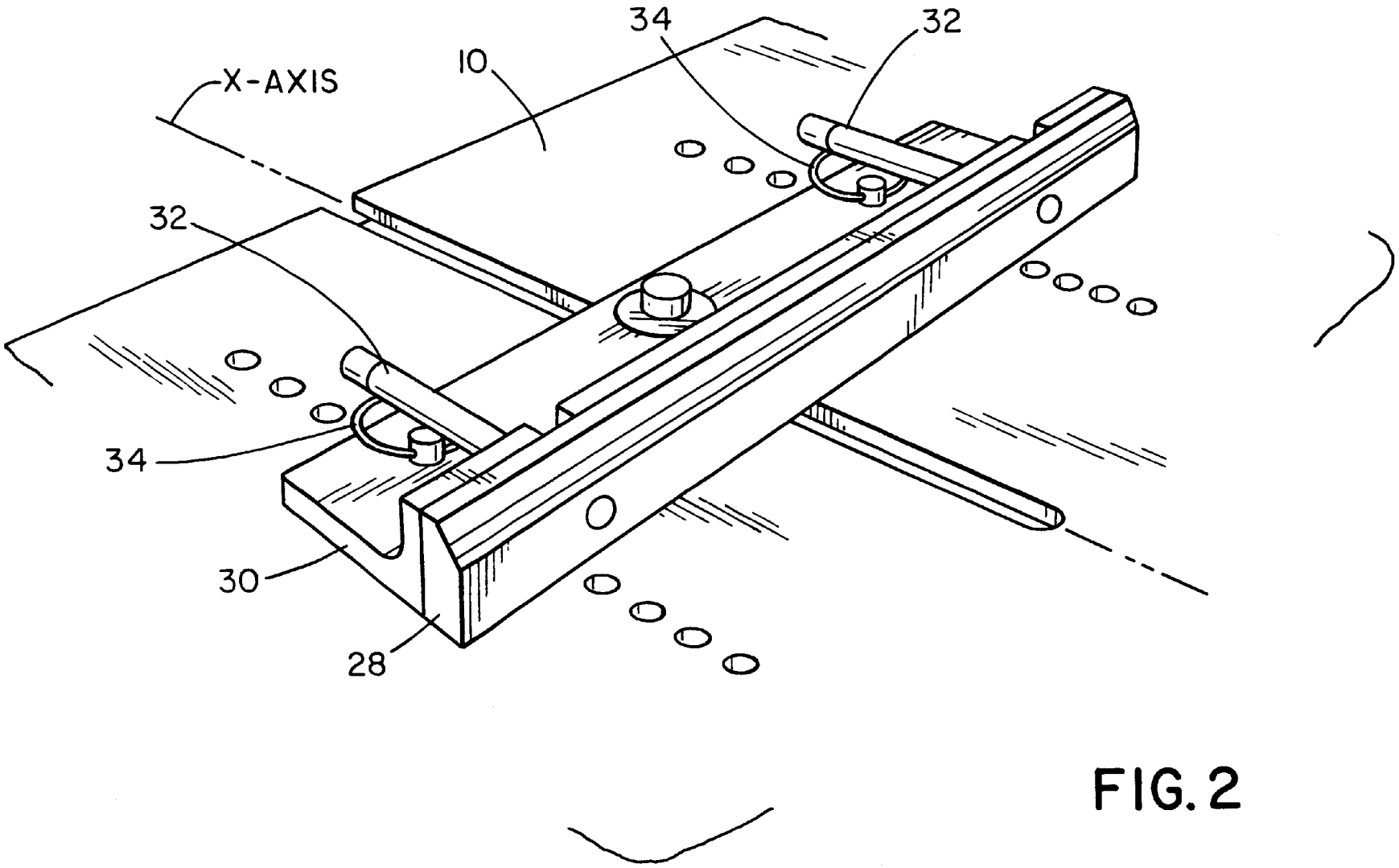
FIG. 2 is a schematic diagram representative of a movable guide bar for use in the present invention.

FIG. 2 depicts schematically a perspective view of x-axis movable guide bar 10. For purposes of FIG. 2 the reader may assume that the components of y-axis movable guide bar 12 are similar to x-axis movable guide bar 10. X-axis movable guide bar 10 preferably includes a protection plate 28, x-axis movable guide bar hardware 30, at least one pneumatic cylinder 32, and at least one x-axis movable guide bar pin 34. X-axis movable guide bar 10 begins moving when board panels (not shown) are place on base plate 4. At this point, pneumatic cylinder 32 begins extending upon initialization by the programmable logic controller (not shown). Extension of pneumatic cylinder 32 allows medial movement of x-axis movable guide bar 10 along the x-axis.

FIG. 3 depicts schematically an underside view of base plate 4 incorporating spine guide rack 36 which enables spine guide 14 to move medially and laterally through spine guide trench 18. Spine guide rack 36 preferably includes: pneumatic cylinder 32, pinion gear 38, movable platform "a" 40, movable platform "b" 42, stop bar 44, and mounting block 46. Pneumatic cylinder 32 operates via a programmable logic controller and operates until it has reached stop bar 44. Pneumatic cylinder 32 enables movable platform "a" 40 and movable platform "b" 42 to have medial and lateral motion along the underside of base plate 4. Pinion gear 38 also enables movement of movable platform "a" 40 and movable platform "b" 42. Pinion gear 38 is located approximately under spine guide trench 18. When pinion gear 38 is activated, movable platform "a" 40 and movable platform "b" 42 move accordingly with pinion gear 38.

Movable platform "a" 40 and movable platform "b" 42 are furthest apart from each other when a spine portion of a board is dropped in between spine guides 14. Movable platform "a" 40 and movable platform "b" 42 each preferably have two spine guide 14 attached which protrude through spine guide trench 18 and above the base plate 4. Medial and lateral movement by movable platform "a" 40 and movable platform "b" 42 therefore provides medial and lateral movement for spine guide 14.

Spine guide rack 36 also preferably includes at least one mounting block 46. Mounting block 46 secures spine guide rack 36 to underside of base plate 4. Mounting block 46 enables unimpeded board panel placement.

Figure 4:
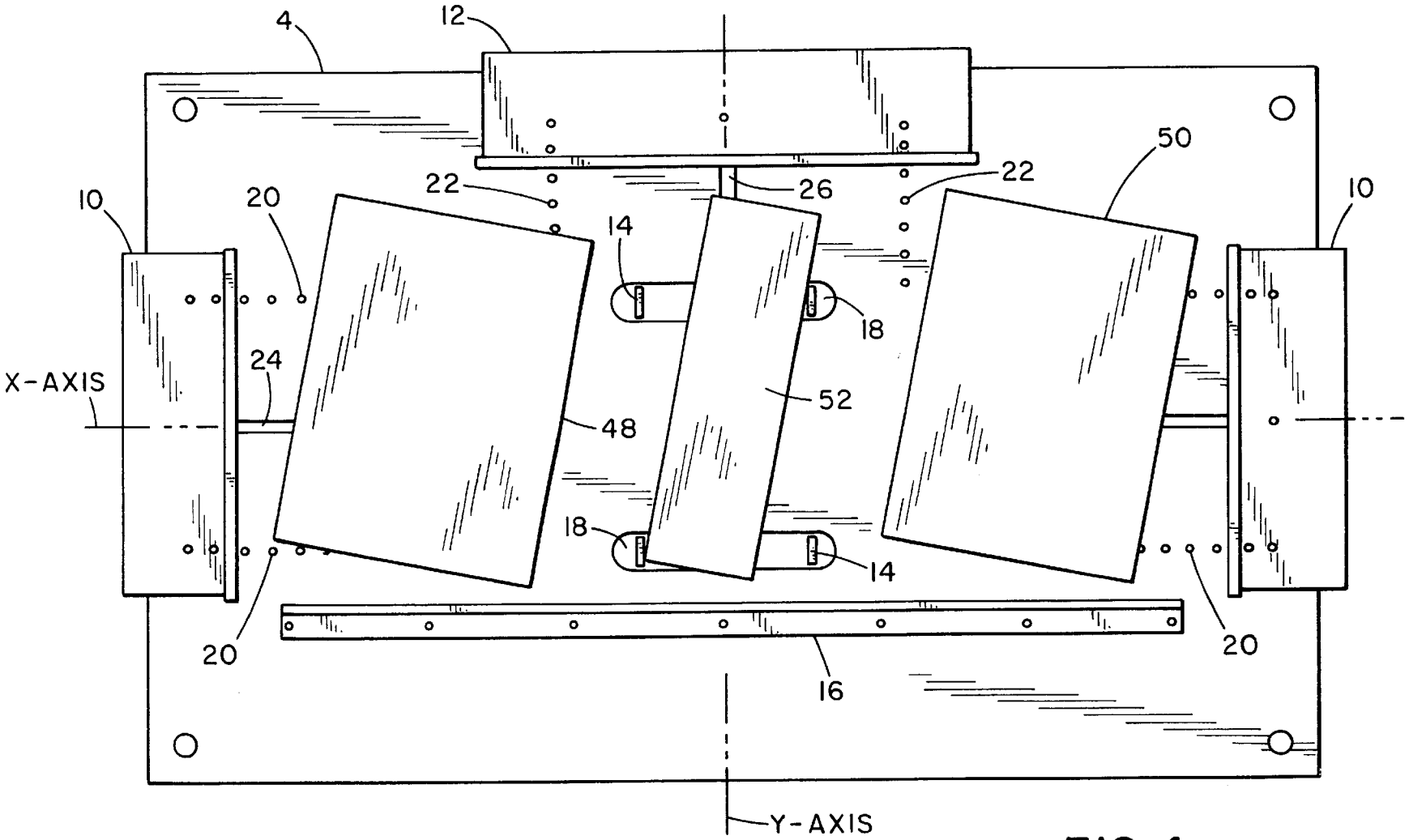
FIG. 4 is a schematic diagram of the system showing boards before the boards are aligned.

FIG. 4 depicts schematically an overview of the present invention when front board panel 48, back board panel 50, and spine panel 52 are placed on base plate 4. Front board panel 48, back board panel 50, and spine panel 52 preferably are placed by automated means. As is shown in FIG. 4, spine guide 14 is positioned laterally from the y-axis. This position enables a varied range of spine panel 52 widths, which is advantageous for pre-registering, for example, different sized binders with the same process. The lateral position of spine guide 14 enables spine panel 52 to be placed automatically or manually without concern for spine panel 52 angular displacement. When spine guide 14 begins to move medially it ultimately corrects angular displacement caused by faulty placement of spine panel 52 on base plate 4. Subsequent to spine guide 14 "squeezing" spine panel 52 to correct angular displacement, x-axis movable guide bar 10 begins moving medially toward the y-axis. Front board panel 48 and back board panel 50 will be pushed toward the y-axis by x-axis movable guide bar 10. When front board panel 48 and back board panel 50 come into contact with spine guide 14 the movement of x-axis movable guide bar 10 will force correction of any angular displacement of front board panel 48 and back board panel 50 by pushing panels against datum bar 16.

Figure 5:
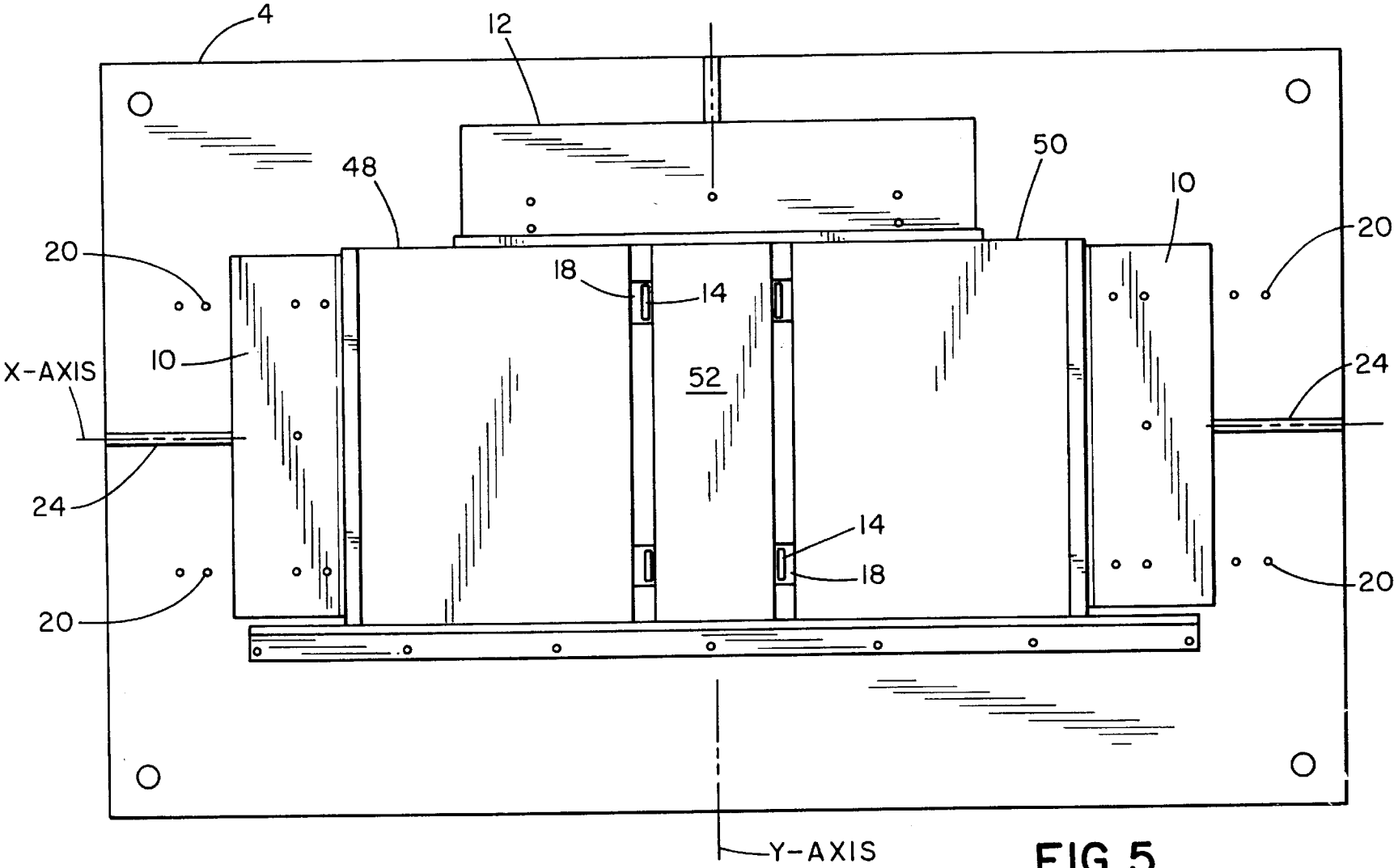
FIG. 5 is a schematic diagram of the system showing boards after the boards are aligned.

FIG. 5 shows schematically an overview of the present invention when angular displacement is corrected and registration of board panels has occurred. When board panels are picked up and moved for further manufacturing, the process starts over and is ready for subsequent board placement.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed:

1. An apparatus for pre-registering boards comprising:

a base plate comprising an array of perforations parallel to at least one of an x-axis and a y-axis;

at least one x-axis movable guide bar for aligning a board;

at least one y-axis movable guide bar for aligning a board; and means for orientating a spine panel of said board comprising:

at least one trench, a plurality of spine guides extending out of said at least one trench and a fixed datum bar parallel to either the x-axis or the y-axis.

2. The apparatus of claim 1 wherein said x-axis and y-axis movable guide bars further comprise movable guide bar pins, which are used to adjust the pre-registration apparatus to accommodate different board sizes.

3. The apparatus of claim 2 wherein said x-axis or y-axis movable guide bar further comprises:

at least one guide for aiding alignment of said board;

means for translating said movable guide bars along the x-axis or the y-axis.

4. The apparatus of claim 1 wherein said means for orientating spine panel of said board further comprises:

at least one spine finger;

means for translating said spine fingers along said x-axis and y-axis.

5. An apparatus for pre-registering boards comprising:

a base plate;

at least one x-axis movable guide bar for aligning a board;

means for said x-axis movable guide bar to be translated along the x-axis;

at least one y-axis movable guide bar for aligning a board;

means for said y-axis movable guide bar to be translated along the y-axis;

means for orientating spine panel of said board comprising at least one spine finger;

means for translating said spine fingers along said x-axis and y-axis;

x-axis movable guide bar pins;

y-axis movable guide bar pins;

an array of perforations on said base plate parallel to the x-axis;

an array of perforations on said base plate parallel to the y-axis;

a trench on said base plate in which means for orientating spine panel of board may move;

a fixed datum bar parallel to either the x-axis or the y-axis.

* * * * *